United States Patent [19]

Martensson

[11] 4,182,064

[45] Jan. 8, 1980

[54] FIREARM HAVING TWO OR MORE BARRELS

[75] Inventor: Marten Martensson, Ostersund, Sweden

[73] Assignee: A B Servator, Syltebruk, Sweden

[21] Appl. No.: 838,887

[22] Filed: Oct. 3, 1977

[51] Int. Cl.[2] ..... F41C 11/10

[52] U.S. Cl. ..... 42/12; 42/76 R

[58] Field of Search ..... 42/12, 1 G, 40, 42 R, 42/76 R

[56] References Cited

U.S. PATENT DOCUMENTS

| | | | |
|---|---|---|---|
| 35,941 | 7/1862 | Lee | 42/12 |
| 182,557 | 9/1876 | Castle | 42/12 |
| 196,748 | 11/1877 | Fox | 42/12 |
| 441,389 | 11/1890 | Brooks | 42/40 |
| 477,410 | 6/1892 | Grouleff et al. | 42/12 |
| 600,834 | 3/1898 | Kurth | 42/40 |
| 804,349 | 11/1905 | Stendebach | 42/40 |
| 1,637,079 | 7/1927 | Karner, Jr. | 42/1 G |
| 2,259,397 | 10/1941 | Smith | 42/42 R |
| 3,352,046 | 11/1967 | Warner et al. | 42/1 G |
| 3,597,870 | 8/1971 | Block | 42/42 R |

*Primary Examiner*—Charles T. Jordan
*Attorney, Agent, or Firm*—Stanley B. Kita

[57] ABSTRACT

An over-under firearm having a breech block, a barrel block, at least one shot barrel mounted in the barrel block and a rifle barrel superimposed on the shot barrel at a small angle relative thereto, and a hinge mounting the barrel block to the breech block to afford pivoting about a vertical axis for loading and unloading.

5 Claims, 2 Drawing Figures

FIREARM HAVING TWO OR MORE BARRELS

Figure 1:
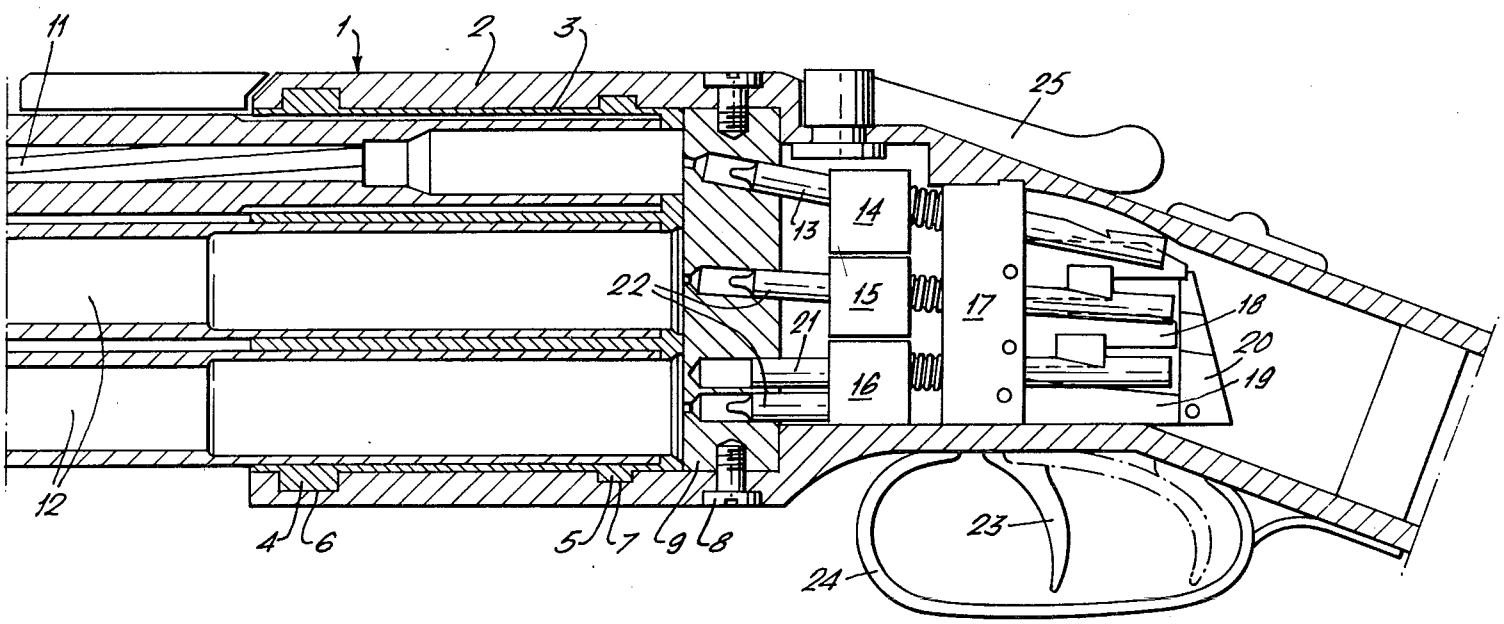

The present invention relates to firearms and in that respect to such weapons which have shotgun as well as rifle barrels and which weapons are arranged to be opened for loading. The weapon according to the invention concerns especially so-called drilling weapons.

There is a need to produce such a weapon by which a predetermined correct score-area not only can be expected but also is obtained when using the weapon. Further, there is a need of such a weapon, which is easier in handling, more reliable in use and which is not worn out in such a way that the aim at the correct score-area is jeopardized or that the weapon after some time of use is deteriorated as a result of wear, whereby the necessary precision is lost when making use of the weapon.

In prior weapons of this type the barrels are designed to drop down when the weapon is broken for loading. Further, the shotgun barrels are arranged at the side of each other in prior drilling-weapons, while the rifle barrel is located on the under-side of the shotgun barrels and placed in the recess, which is formed between the shotgun barrels. In this connection the effectiveness or action of the recoil is taken up in a level nearer the weapons break centrum or the pivot than if the rifle barrel would be located over the shotgun barrels. However, the location of the rifle barrel does not affect any crucial change concerning the wear of the weapon. Instead the weapons have been worn out proportionately fast by the actions of the recoil, whereby loosening occurs between the barrel-block of the weapon and its breech-frame. Thus, these prior weapons have not achieved the desired degree of accuracy. Further, the barrels of these weapons create a small tilting or turning movement when the weapon is fired, which, or course, have an injurious effect on the accuracy in firing.

The problems existing with the weapons referred to are unsolved. This depends principally on the fact that the barrels are arranged for a drop-down movement when the weapon is broken, as the barrels are arranged at the side of each other, whereby loosening occurs. A part solution of the problem presented by these weapons would be to arrange the barrels of the weapon in such a way that they are turned sideways when the weapon will be loaded. However, a turning of the barrels sideways is excluded, as the breech-frame of the weapon is so broad that the barrels when they are swung out are going to hit against the breech-block of the weapon.

However, by the weapon according to this invention one can overcome said inconveniences, which exist in the prior weapons at the same time as the weapon according to the invention fullfils the demands drawn up for a weapon of the type in question. The weapon according to the invention is characterized in that the barrels are arranged above each other and arranged to turn sideways for loading.

By a weapon, which is shaped in such a way, the recoil from the rifle barrel will not have an influence on the weapon to a breaking of the weapon. Further, the weapon will not be exposed to such a wear that it after some time is going to be impaired but instead the weapon can be used all the time for which it is intended and with the same precision.

Figure 2:
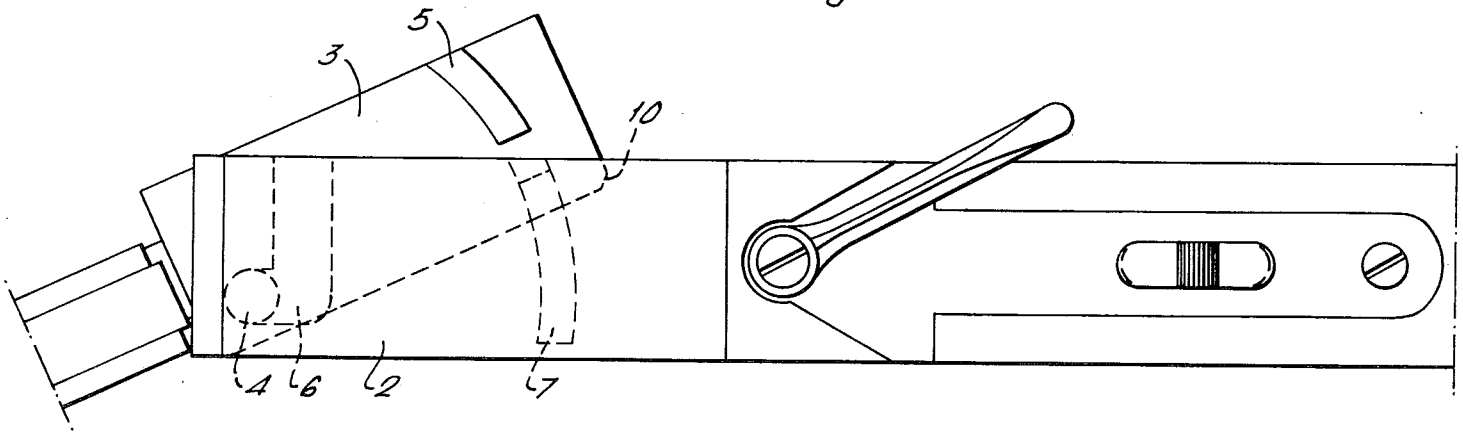

Further characteristics and advantageous features for the weapon according to the invention will be evident from examples in the following description of the invention, whereby a contemporary reference will be made to the enclosed schematic drawings, wherein FIG. 1 shows partly and in a longitudinal section one embodiment of the weapon according to the invention and FIG. 2 shows a plan of the weapon shown in FIG. 1 but in an opened position for loading.

In FIG. 1 reference indication 1 indicates an embodiment of a weapon according to the invention and showing a breech-frame 2 and a barrel-block 3, which is arranged hinged in the breech-frame. Further, there is arranged a breech-block 9, which is arranged fixed to the breech-frame by means of screws 8. The barrels 11 and 12 of the weapon are located above each other and arranged fixed in the breech-block. The weapon shows one rifle barrel 11 and two shotgun barrels 12 according to one embodiment of the weapon according to the invention, whereby the rifle barrel is located above the shotgun barrels.

Further, in FIG. 1 is shown an upper firing pin 13, an upper hammer 14, a center hammer 15, a lower hammer 16, a trigger stud 17, a sear or a trigger rod 18 for the upper shotgun barrel, a sear or a trigger rod 19 for the lower shotgun barrel, a trigger bar 20, a bar for the firing pin spring 21, firing pins 22, a trigger 23, a trigger guard 14 and a top level 25.

The barrel-block 3 is arranged for turning or pivoting sideways into the breech-frame 2 and shows pivot pins 4, which are guided into recesses 6 in the breech-frame, see also FIG. 2. The recesses extend respectively from a free edge of the breech-frame and continue in a perpendicular extension in the direction of the weapon, where the pivot pins of the barrel block are pivoted for the pivoting of the barrel block into the breech-frame. Further, the barrel block 3 shows guiding ribs, which project from the upper surface and the lower surface of the barrel block 3, whereby the guiding ribs are designed for the reason to be in an engagement with grooves 7, which are arranged in the breech-frame 2. The guiding ribs 5, which in the main are located across the barrel block 3, are chiefly intended for taking up the pressure of the barrels when a shot is fired, i.e. to relieve the pressure on the pivot pins 4 from the action of the recoil. Besides, the guiding ribs show a shaping for making it possible to turn or to tilt the barrel block in the breech-frame.

The weapon according to the invention fullfils the demands from for example huntsmen in that a correct score-area can be obtained, which depends on the fact that the barrels are arranged above each other and the fact that the barrels are arranged for tilting sideways, for example when loading the weapon. According to the invention the barrels 11 and 12 are further arranged stationary between themselves by the fact that they are arranged in the barrel-block and further, the barrels are along the barrels direction or preferably at the free end of the barrels unit of a holder. According to another embodiment the rifle barrel 11 is arranged in one direction, while the shotgun barrels 12 are arranged in a small angle to the rifle barrel. Said angle between the directions of the shotgun barrels and the rifle barrel is about 0.5° or at most 2° but preferably between 0.3° and 0.7°. Several advantages are obtained by the stationary arrangement of the barrels and further that they are arranged inclined to each other. Among other things one obtains a more correct score-area and from the viewpoint of accuracy in firing the weapon has been considerably improved compared with prior weapons of this type. Thus, prior weapons have shown a wedge the barrels for the purpose to attain the leaning of the shotgun barrels. In this case one has to separate the barrels by the wedge. However, one has learnt from experience that this shaping is not satisfactory from among other things the viewpoint of accuracy in firing, while the barrels are not arranged stationary, whereby some loosening has been obtained. Besides, one obtains a considerably easier weapon to handle when using the weapon according to the invention, which depends on the fact that one can make use of stationary sights, i.e. bead and sight are arranged stationary, whereby there is no need to adjust the sights after using the rifle barrel to use of a shotgun barrel. Thus, prior weapons of this type show an especial "swtich over" device, by which a specific rifle sight is lowered before a bullet is to be fired. A "switch over" handle of the sight is troublesome, particularly when a huntsman is in the position of firing a shot. When using the weapon according to the invention one obtains instead a perfect bullet- and shot dispersion by using the arranged stationary sights.

As mentioned above, the weapon according to the invention shows a breech-block 9, which is arranged stationary instead of a turnable breech-block, whereby a turnable breech-block would probably be more natural in consideration of the shaping shown. A stationarily arranged breech-block is possible by the shaping shown of the weapon but to make it easier to turn the barrel block sideways, the barrel block can be designed with a chamfering portion 10 arranged at one of the barrel block edges and along the total height of the barrel block. Further, the position of the fixed pivot of the barrel block can be moved and located by the side of the common symmetry plane as it appears from FIG. 2.

Without exceeding the scope of the concept of the invention, modifications may be made to the weapon shown and described. Thus, it is quite possible to design a drilling weapon, which differs from the natural drilling weapon, for example by designing a hydrid form of a drilling by an arrangement of two rifle and two shotgun barrels. Further, it is possible to design the weapon according to the invention with one or two rifle barrels and only one shotgun barrel. Therefore, the invention is not limited to the embodiment shown and described, but only by the following patent claims.

I claim:

1. An over-under firearm comprising: a breech block, a barrel block, at least one rifle barrel and at least one shot barrel mounted in said barrel block and superimposed relative to one another, means mounting said rifle barrel at a small angle relative to the shot barrel to compensate for the different trajectories of projectiles discharged from the barrels, and means mounting said barrel block to pivot about a vertical axis relative to said breech block so that the rear ends of said barrels are offset laterally with respect to the breech block for loading and unloading.

2. An over-under firearm according to claim 1 wherein said angle between said barrels is less than 2°.

3. An over-under firearm according to claim 2 wherein said angle is in a range of between 0.3° and 0.7°.

4. An over-under firearm according to claim 3 wherein said rifle barrel is disposed above said shot barrel.

5. An over-under firearm according to claim 4 including a second shot barrel disposed below said first-mentioned shot barrel and parallel thereto.

* * * * *